US007176399B2

(12) United States Patent
Graiger et al.

(10) Patent No.: US 7,176,399 B2
(45) Date of Patent: Feb. 13, 2007

(54) SAFETY SWITCH DEVICE FOR ELECTRICALLY CONTROLLED MACHINES

(75) Inventors: Dieter Graiger, Pasching (AT); Hans-Peter Wintersteiger, Hagenberg (AT); Martin Danner, Gallneukirchen (AT)

(73) Assignee: Keba AG, Linz (AT)

( * ) Notice: Subject to any disclaimer, the term of this patent is extended or adjusted under 35 U.S.C. 154(b) by 223 days.

(21) Appl. No.: 10/485,127

(22) PCT Filed: Jul. 19, 2002

(86) PCT No.: PCT/AT02/00215

§ 371 (c)(1),
(2), (4) Date: Aug. 16, 2004

(87) PCT Pub. No.: WO03/012809

PCT Pub. Date: Feb. 13, 2003

(65) Prior Publication Data

US 2005/0011740 A1 Jan. 20, 2005

(30) Foreign Application Priority Data

Jul. 31, 2001 (AT) ..... A 1192/2001

(51) Int. Cl.
*H01H 13/00* (2006.01)

(52) U.S. Cl. ..... 200/334; 200/330; 200/344; 200/5 R

(58) Field of Classification Search ..... 200/334, 200/341, 343, 344, 330, 332, 520, 5 R, 61.7
See application file for complete search history.

(56) References Cited

U.S. PATENT DOCUMENTS 3,771,636 A 11/1973 Kerns (Continued)

FOREIGN PATENT DOCUMENTS

DE 19909968 9/1999

(Continued)

*Primary Examiner*—K. Lee
(74) *Attorney, Agent, or Firm*—Collard & Roe, P.C.

(57) ABSTRACT

The invention relates to a safety switch unit (1) for electrically controlled machines for use in combination with the actual control elements of the machine control system in a hand-held application or for manual control, with at least one operating element which is displaced relative to a mounting frame (8) in accordance with the switching function desired by a user, which is designed to change the switch status of at least one electric switch element, the safety switch unit (1) having at least one switch position which is maintained only as long as a sufficiently high operating force is applied to the displaceable operating elements. Two operating elements for at least one respective electric switch element (14, 15) can be displaced in translation or rotation to a limited degree relative to the mounting frame (8) about a respective pivot axis of two pivot bearings and provide a substantially translating or straight operating movement of the safety switch unit (1) by means of a push button unit (2) which is disposed in front of the two operating elements by reference to the operating direction—arrow (13)—of the safety switch unit (1).

9 Claims, 6 Drawing Sheets

U.S. PATENT DOCUMENTS

| | | | | |
|---|---|---|---|---|
| 4,295,017 | A * | 10/1981 | Kashima et al. | 200/47 |
| 4,720,608 | A * | 1/1988 | Mizuta | 200/5 B |
| 4,967,467 | A * | 11/1990 | Udagawa | 29/622 |
| 5,932,854 | A * | 8/1999 | Umemura | 200/5 B |
| 6,454,487 | B1 * | 9/2002 | Buenning et al. | 403/400 |
| 6,841,751 | B2 * | 1/2005 | Sasaki et al. | 200/553 |

FOREIGN PATENT DOCUMENTS

| | | |
|---|---|---|
| EP | 0033985 | 8/1981 |
| EP | 0702384 | 3/1996 |
| EP | 0734817 | 10/1996 |
| WO | WO 93/09377 | 5/1993 |

* cited by examiner

SAFETY SWITCH DEVICE FOR ELECTRICALLY CONTROLLED MACHINES

CROSS REFERENCE TO RELATED APPLICATIONS

Applicants claim priority under 35 U.S.C. §119 of Austrian Application No. A1192/2001 filed on Jul. 31, 2001. Applicants also claim priority under 35 U.S.C. §365 of PCT/AT02/00215 filed on Jul. 19, 2002. The international application under PCT article 21(2) was not published in English.

The invention relates to a safety switch unit for electrically controlled machines, for use in combination with the actual control elements of the machine control system in handheld applications or for manual control, as defined in claim 1.

Patent specification DE 199 09 968 A1 filed by the same applicant describes a safety switch unit for electrically controllable machines. This safety switch unit has several contact stages and two mutually independent, redundant switch circuits. The active contact stages of the safety switch unit are provided in the form of a key function, i.e. they can only remain active as long as they are being actively depressed by a user. Detection systems which operate without contacts are provided as a means of detecting the respective switch position and are connected to an electronic evaluation circuit. Two operating elements are used to switch to the different contact states and are disposed so as to be linearly slidable relative to a housing in which they are partially enclosed. A linking arrangement or cap connecting the two operating elements is provided, the purpose of which is to allow the operating elements to be displaced simultaneously. It is also stated that the housing has guide tracks designed so that the operating elements can be guided substantially without any clearance. As an alternative, it is also pointed out that rotating motions can also be effected with the operating elements in order to initiate the desired switching function. The specified construction requires relatively large integration depths, which means that this design is not suitable for all applications. Moreover, the more it is used, the more the arrangement proposed for guiding the linear or rotary motions of the operating elements is at risk of mechanical jamming caused by dirt or abrasive wear on the slide surfaces, for example. The guided sliding or rotating motions also need to be very precise, which increases the cost of producing the safety switch unit.

The underlying objective of the present invention is to propose a safety switch unit of high mechanical functioning reliability which can be operated in the standard fashion.

This objective is achieved by the invention as a result of the characterising features defined in claim 1.

The advantage of this approach is that the safety switch unit is built so as to incorporate two full circuits, including from a mechanical point of view, and therefore meets the criteria of so-called fail-safe control. Another major factor is the specific way in which the operating elements are mounted so as to pivot about pivot axes, which provides a mechanically very reliable design that is guaranteed to function perfectly and unimpaired irrespective of the number of operating cycles. In particular, the operating properties of the specified safety switch unit remain unaltered, even after numerous operating cycles, and it is not susceptible to any significant wear. Also of particular advantage is the fact that any risk of the operating elements sticking, moving out of line or even jamming altogether is minimised due to the way in which the operating elements are mounted so as to rotate about the corresponding pivot axes, thereby conforming to high safety requirements. The rotary mounting of the operating elements will not adversely effect the trigger behaviour of the safety switch even if the operating force applied by the user is off-centre, which means that it will be possible to output the respective switch commands correctly even in panic situations or if the safety switch unit is being held incorrectly or carelessly. The push button unit nevertheless enables a substantially linear operating motion for the safety switch unit to be achieved, thereby constituting the basis for intuitive and familiar operation by the respective user.

As a result of the embodiment defined in claim 9, the points at which force is introduced into the push button unit are essentially fixed and are disposed above the switch elements, thereby enabling the force to be transmitted to the switch elements as directly as possible. In addition, this motion does not have to be reversed and instead the adjustment direction of the safety switch unit may be the same as the adjusting direction for triggering switching procedures in the switch elements.

The embodiment defined in claim 11 offers a simple way of enabling special switching states of the safety switch unit to be detected without the need for complex latching or locking mechanisms.

As a result of the embodiment defined in claim 14, switch elements that are intrinsically relatively sensitive can be accommodated in a perfectly stable manner in a plastic housing and the switch elements will still be very resistant to breakage and damage, even if the operating force is applied quite forcefully, as would be the case in panic situations, or if the correct operating mode were not used.

As a result of the embodiment defined in claim 17, in spite of the relatively large surface available on the push button unit for operating purposes, the safety switch unit is still relatively small in terms of its construction size. In particular, the specified safety switch unit can also be integrated in a device housing in which only a shallow depth is available for integration purposes.

The advantageous embodiment defined in claim 5 or 6 on the one hand ensures that the operating elements are mounted so that they will not become blocked or move out of line and on the other hand provides a central zone at which force is introduced. Furthermore, the fact that the operating elements merge with one another within the zone in which force is introduced ensures that the operating elements will always be correctly operated by the user even though the two operating elements are mechanically independent or each mounted separately and not positively coupled with one another in displacement.

With the embodiment defined in claim 21, the operating elements roll in a sliding arrangement relative to the push button unit when pivoted about their pivot axes and the push button unit is supported on the operating elements with as little friction as possible. In particular, an easy relative displacement is produced between the operating elements and the push button unit disposed in front within the force transmission zone, whilst inducing as little friction as possible The embodiment defined in claim 24 ensures that the operating elements, which are mounted so that they move independently of one another, are always moved simultaneously and conforming to the same shape when operating force is applied to the rubber-elastic cover element. In addition, the substantially dimensionally stable pressuretransmitting block rules out the possibility of misalignment between the cover element or push button unit and the pivoting operating elements.

As a result of the embodiment defined in claim 27, the safety switch unit can be switched from the contact stage constituting the confirmation state to the contact stage representing panic mode without unacceptably high forces on the switching elements affecting the normally open contacts. In addition, the requisite operating forces are such that they are perceptibly different because the resiliently flexible compensating elements have to be deformed in order to switch from confirmation to panic mode.

The invention will be explained in more detail with reference to examples of embodiments illustrated in the appended drawings.

Of these:

Figure 1:
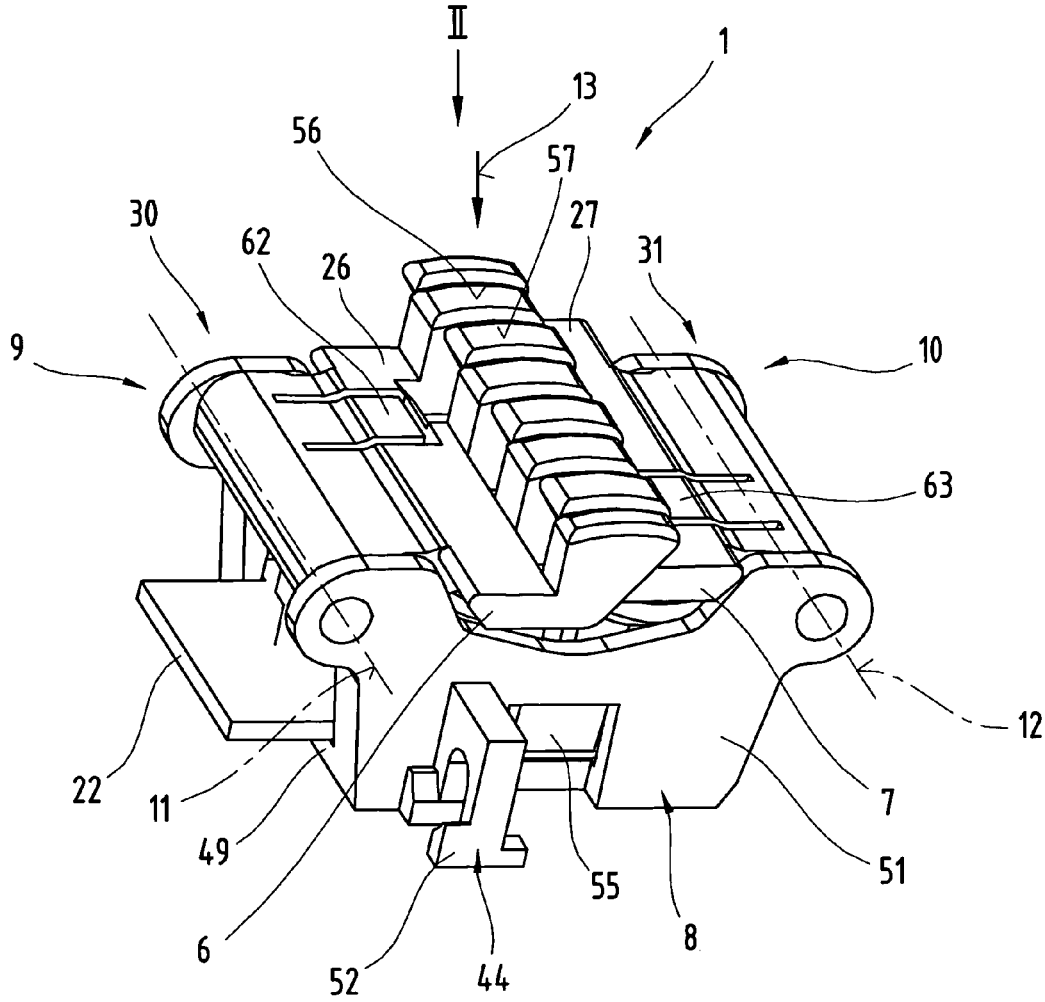
FIG. 1 is a simplified perspective diagram illustrating an embodiment of the safety switch unit.

Firstly, it should be pointed out that the same parts described in the different embodiments are denoted by the same reference numbers and the same component names and the disclosures made throughout the description can be transposed in terms of meaning to same parts bearing the same reference numbers or same component names. Furthermore, the positions chosen for the purposes of the description, such as top, bottom, side, etc., relate to the drawing specifically being described and can be transposed in terms of meaning to a new position when another position is being described.

FIGS. 1 to 4 are simplified partial diagrams illustrating an embodiment of the safety switch unit 1, intended to highlight the structure and operating mode.

This safety switch unit 1 is preferably operated by a user who applies pressure with the finger. Naturally, however, it would also be possible for the safety switch unit 1 to be designed so that it can be operated by the foot. The safety switch unit 1 is intended as a means of controlling machines or robots in combination with the actual control elements of the electric machine control system and, this being the case, is specifically used to provide manual control of motion and function sequences of a machine. For example, the safety switch unit 1 proposed by the invention is used during manual operation of a multi-axis robot arm or multi-axis processing machines, for example. The safety switch unit 1 is thus used in combination with the actual control elements which have to be operated by the user, such as a controller stick, a controller ball or a so-called "track ball", directional control keys or similar for example, thereby enabling the machine under control to perform a movement or function intended by the user only when the safety switch unit 1 is operated in a pre-defined manner. The safety switch unit 1 is therefore comparable to a confirmation system and can be integrated in a stationary or mobile handheld control device for the machine or alternatively it can be used in conjunction with a switch or control lever or similar.

The safety switch unit 1 is used for so-called "teach-in procedures" or learning processes for robots, during which the motion sequence to be performed by the robot arm is pre-set beforehand by means of a manual control, after which the robot performs the motion sequence learned during the manual control process on its own.

The safety switch unit 1 is designed to operate on the basis of a push button in particular, i.e. the switch position initiated by the user is maintained only as long as the safety switch unit 1 is consciously operated.

The safety switch unit 1 is therefore connected to at least some of the individual control elements on a handheld device or control panel for the respective machine so as to operate in what is virtually a serial mode. In other words, the machine will not perform the motion or function intended by the user unless the safety switch unit 1 is being operated in addition, preferably by the second hand of the user, thereby providing confirmation of the motion or sequence to be performed. The safety switch unit 1 therefore fulfils a safety function since it ensures that unintentional activation of the control elements for the machine or automated manipulator, caused by jostling for example, can not cause uncontrolled movements or functions. Similarly, if a mobile handheld device drops to the floor or is subjected to impact stress, no critical control commands will be output unless the safety switch unit 1 is simultaneously being operated in such a way that the confirmation mode is assumed.

The safety switch unit 1 may optionally also have a panic mode or emergency stop function, which can be initiated rapidly and reliably in the event of a risk situation. In practice, since a hand or at least one finger of the user is supported on the safety switch unit 1 when critical motions or functions are being performed, only a short additional operating path has to be covered in order to ensure rapid switching when necessary.

The specified safety switch unit 1 can reduce the risk of injury to personnel on the one hand and minimise the risk of damage to machine parts or workpieces on the other, which all in all makes control of the corresponding machine relatively safe. The construction of the safety switch unit 1 described below is very reliable both in terms of mechanical and electrical operating functionality, so that these safety aspects are always preserved.

In addition to an initial or inactive position, the safety switch unit 1 has at least two switch positions and optionally also three different switch positions. In the first switch position or contact stage, in which the safety switch unit 1 is not being operated by the user, no confirmation is given for a critical movement of a machine part or a dangerous function of the machine being controlled and operated. In order to assume the second switch position or contact stage, the safety switch unit 1 must be operated, preferably by at least one finger of the user, and only at this stage is the authorisation given for the machine to perform a helical movement or function, for example. This authorisation or confirmation continues to apply only if the depressed position of the safety switch unit 1 is maintained accordingly, in particular is maintained only as long as a displaceably mounted push button unit 2 (FIG. 3) of the safety switch unit 1 is actively depressed in the second contact stage. When the push button unit 2 is released, it immediately returns to the initial or inactive position illustrated in FIGS. 1 and 3. In this initial or inactive position of the safety switch unit 1 or push button unit 2, therefore, the performance of safety-critical movements or functions is not authorised. The safety switch unit 1 is therefore designed as an automatic re-set button and, from a construction point of view, contains no mechanical locks or latches to maintain its active switch positions or contact stages.

In the embodiment illustrated in FIGS. 1 to 4, the safety switch unit 1 may be of a triple-action design, in which case the push button unit 2 will not give authorisation for a critical movement or function of the machine to be performed when switched to the third or last switch position and at this point in time any functions or movements of the respective machine which are safety protected and might have been active are terminated immediately. This third contact stage is usually triggered by the user as a reflex reaction in the event of a panic situation and as a rule is not intentional. For example, if there is a risk of injury to the user himself or any other persons in the area around the respective machine, this will usually be transmitted to the safety switch unit 1 by a reflex reaction, so that the push button unit 2 is moved via the second contact stage and beyond into the last or third switch position. The same situation can arise if there is suddenly an acute risk of the respective machine or the processed product being damaged. The "panic" or "emergency stop" switch mode on the safety switch unit 1, which may be optionally implemented and if necessary permanently maintained and optionally actively re-set, is applied as a result of appropriate precautions or features in the electric design of the safety switch unit 1 or the machine controller. In other words, there are no mechanical locks or latches for the third switch mode triggering the "panic mode" in the mechanics of the safety switch unit 1.

A movement of a machine part or the performance of a function by a machine can not be authorised again until the push button unit 2 has been fully released and the push button unit 2 operated again, starting from the inactive position and moving into the second contact stage. As the safety switch unit 1 is being re-set, in particular as the push button unit 2 is switched from the third contact stage (panic) via the immediately consecutive contact stage (authorisation) back to the first contact stage (inactive position), the safety switch unit 1 does not permit any authorisation—not even briefly—so that there is no way in which the machine an be activated again—even briefly—if the push button unit 2 was previously in the third contact stage (panic) and then released again. This so-called function lock or prevention of undesired or critical switch or operating modes of the safety switch unit 1 is preferably accomplished by using an electronic control or evaluation device for the safety switch unit 1. This control or evaluation device is therefore provided either in the form of a separate linked unit directly on the safety switch unit 1 or the electronic control or evaluation device 2 is disposed externally to the safety switch unit 1. In particular, the control or evaluation unit 3 may also be provided as a part of the control electronics of a handheld device or any other electronic machine control system.

Irrespective of whether the safety switch unit 1 is of a double-action or multi-action design, it is of a multi-channel or multi-circuit design, so that if one electric circuit fails, at least one other electric circuit remains operational and will continue to assume the respective functions, thereby guaranteeing a high probability that the safety switch unit 1 will not suffer a total failure. The safety switch unit 1 can therefore be classed as falling within the category known as "failsafe" switch elements, the functional reliability of which is significantly higher than that of conventional switch elements. The safety switch unit 1 preferably has two separate electric switch circuits 4, 5, each of which is independent of the other, and each electric switch circuit 4 and 5 has a separate mechanical operating element 6, 7. In particular, the operating element 6 co-operates with the first switch circuit 4. This being the case, the switch circuit 4 is designed to detect the respective position of the displaceable operating element 6 and to forward corresponding information or control commands to the control or evaluation device. The second switch circuit 5 co-operates with the other operating element 7 and is likewise designed to generate appropriate signals or control commands for the control or evaluation device depending on the position of the operating element 7. The safety switch unit 1 therefore constitutes a full dual-circuit system, both from an electrical and a mechanical point of view. In particular, this design offers both a mechanical and an electrical redundancy for the safety switch unit 1.

The two operating elements 6, 7 are mounted on a dimensionally stable mounting frame 8 or in an appropriate support element. The important point is that the two operating elements 6, 7 can be rotatably displaced or pivotably displaced to a limited degree by means of two separate pivot bearings 9, 10 for each operating element 6, 7. These pivot bearings 9, 10 on the mounting frame 8 thus form two pivot axes 11, 12 extending transversely to the longitudinal extension of the bar-type operating elements 6, 7. The push button unit 2 is disposed in front of the two operating elements 6, 7, by reference to an operating direction—arrow 13—of the safety switch unit 1.

The push button unit 2 is therefore connected to the two pivotably mounted operating elements 6, 7 so as to guarantee and produce a substantially translating or linear operating motion of the safety switch unit 1. This linear or translating operating motion of the safety switch unit 1 is effected starting from the inactive position in the direction of arrow 13 into the authorisation position and optionally into a panic or emergency stop position. If the push button unit 2 is moved in a straight line relative to the mounting frame 8 as indicated by arrow 13, the operating elements 6, 7 are pivoted about the pivot axes 11, 12 thus changing their operating states, in particular the contact states of the two electric switch circuits 4, 5. Each switch circuit 4, 5 preferably has at least one electric switch element 14, 15. These switch elements 14, 15 are preferably provided in the form of switch contacts, which may be of a standard type. The switch circuits 4, 5 each have at least one electric normally open contact 16, 17. Especially if the safety switch unit 1 is of a three-stage design with an emergency stop or panic function, each switch circuit 4,5 is provided with at least one respective electric normally closed contact 18, 19. These normally closed contacts 18, 19 are operated specifically when the third switch position of the safety switch unit 1 or push button unit 2 is assumed, thus enabling the control or evaluation system 3 to detect an emergency stop or panic situation. The normally closed contacts 18, 19 may alternatively or also directly intervene in a switch circuit to be protected and halt the respective machine functions or machine movements or initiate other safety measures, such as an emergency shut-down, for example.

The normally open contacts 16, 17 are operated when the second switch position or authorisation position is assumed, in particular when they are switched to the closed contact state. This active contact state of the normally open contacts 16, 17 is detected by the control or evaluation device, after which appropriate actions are initiated. In particular, the control elements of the machine control system to be protected are functionally released for normal use.

The switch elements 14, 15 are preferably provided in the form of electromechanical switch contacts. Alternatively, the switch elements 14, 15 could also be provided as inductive, capacitive, optical or magnetic detection elements or detection elements operating on some other physical principle.

The switch elements 14, 15 are preferably provided in the form of standard, commercially available electromechanical switch elements 14, 15 designed for printed circuit board mounting. The spring means needed for re-setting the normally closed contacts 18, 19 and normally open contacts 16, 17 are already provided in the interior of these components or switch elements 14, 15 and no additional spring or re-setting means are needed to construct the safety switch unit 1. Using nothing more than the existing re-setting means in the standard components or switch elements 14, 15, the safety switch unit 1 is constructed so that they are reliably returned to the initial or inactive position when the operating forces applied by a user to the push button unit 2 are released. One of the reasons for this high functional reliability is the pivot bearings 9, 10 used for the operating elements 6, 7, which are particularly effective in preventing misalignment and guarantee long-term functional safety. The fact that no additional spring or re-setting means are needed for the operating elements 6, 7 or for the push button unit 2 of the proposed safety switch unit 1 significantly enhances mechanical operating reliability still further. The switch elements 14, 15, available as standard components, have been widely tried and tested and such commercially available components will guarantee functional reliability for thousands of operating cycles.

It is preferable if the operating force which has to be applied in order to displace or switch the normally closed contacts 18, 19 is greater than the operating forces necessary to switch the normally open contacts 16, 17. This will result in a clearly perceptible difference between the switch positions of the safety switch unit 2, 3. Furthermore, the sum of the operating forces to be applied to the normally open contacts 16, 17 and the normally closed contacts 18, 19 in each switch circuit 4, 5 is such that the displacement force needed to switch the safety switch unit into the third switch mode or panic position rises by a step. The clearly perceptible pressure point between the second switch position (confirmation position) and the third switch position (panic position) significantly facilitates manipulation of the safety switch unit 1, virtually ruling out faulty or incorrect control of the safety switch unit 1.

The mechanical structure and kinematic design of the safety switch unit 1 described above ensures that the push button unit 2 is displaced in as straight a line as possible, even if operating force is applied at an angle or off-centre. The described mechanical design also ensures that the respective switch elements 14, 15 of each switch circuit 4, 5 are operated as far as possible simultaneously and conforming to the same shape. If the control or evaluation device detects that the signals of the respective identical switch elements 14; 15 in the two switch circuits 4, 5 follow one after the other in time or there is too long a time lag, it can be concluded that the function of the safety switch unit 1 is impaired and an appropriate warning signal can be issued under the control of the control or evaluation device 3. Likewise in situations where only a single signal can be generated or received by the two parallel switch circuits 4 and 5, an appropriate alert or warning signal can be output by the control or evaluation device 3. Optical and/or acoustic output elements may be used for signalling purposes. To implement acoustic signalling, a summer or similar may be provided, either directly on the safety switch unit 1 or alternatively connected to the central control or evaluation unit.

Figure 3:
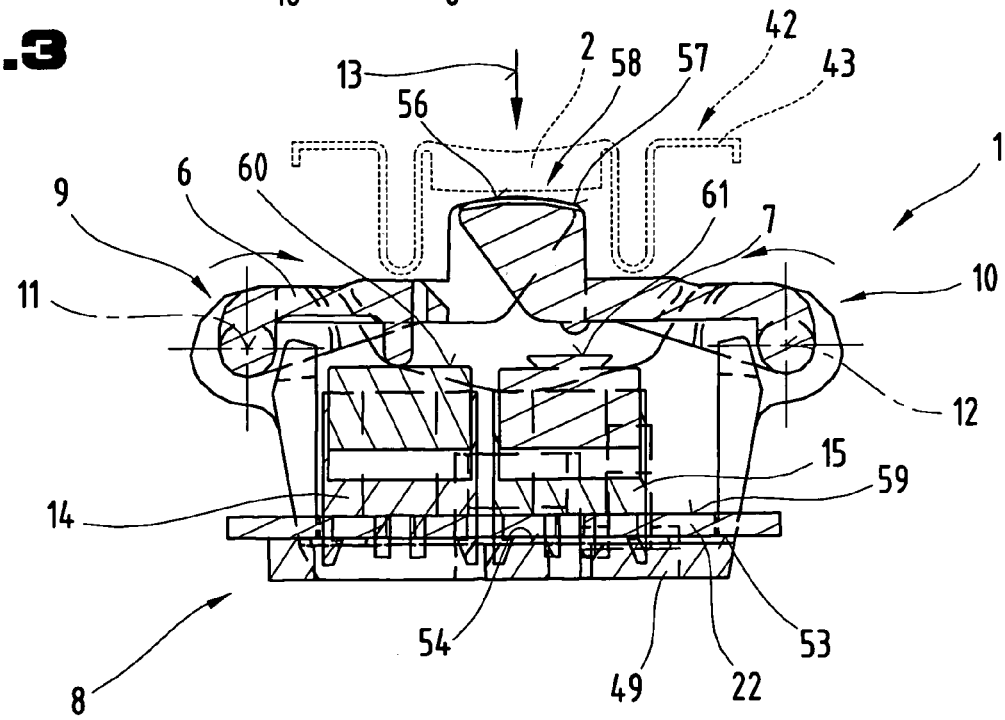
FIG. 3 is a simplified diagram of the safety switch unit illustrated in FIG. 2 in section along line III—III.
Figure 4:
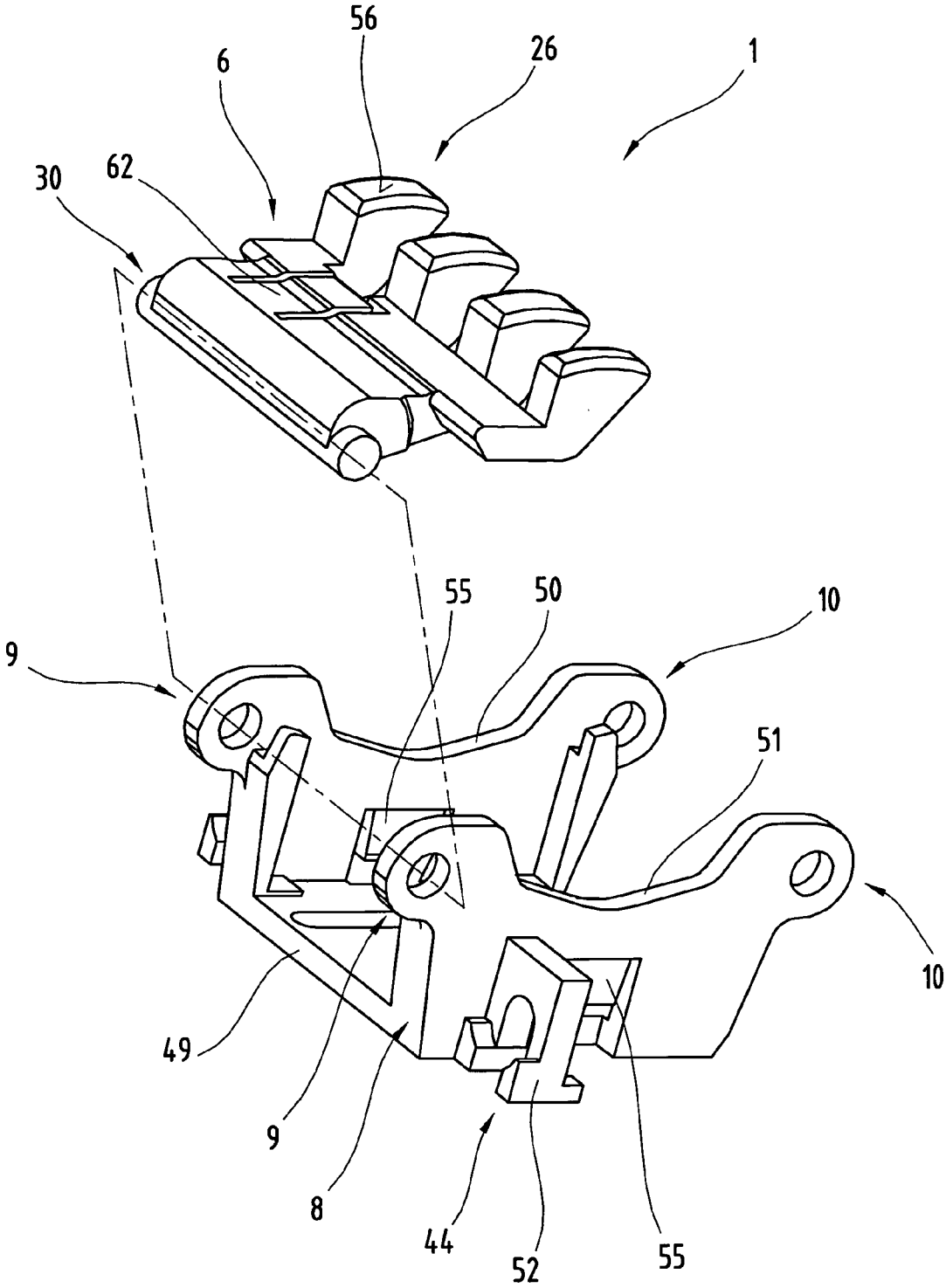
FIG. 4 is a perspective diagram showing individual parts of the safety switch unit illustrated in FIG. 1 with the mounting frame and a pivotable operating element.
Figure 5:
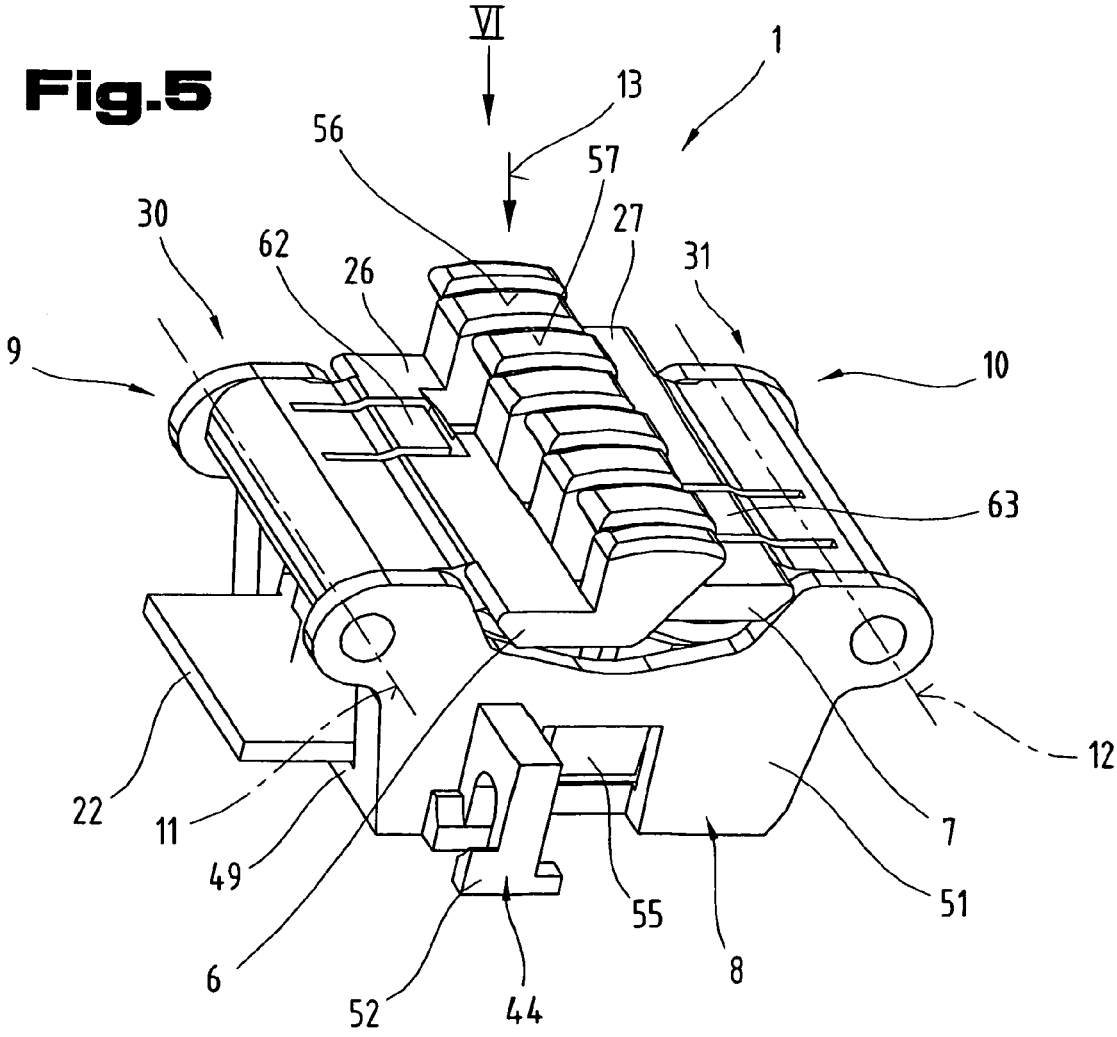

As may best be seen from FIG. 3, the push button unit 2 and the bearing points and displacement clearances for the mechanical components of the safety switch unit 1 are surrounded or covered by an elastically resilient, deformable cover element 42. The cover element 42 is preferably provided in the form of a rubber membrane 43, which bounds the operating elements 6, 7 and the push button unit 2 relative to the surrounding region and prevents ingress by foreign bodies and moisture. The soft-elastic, resilient cover element 42 with the push button unit 2 and/or the mounting frame 8 disposed behind or underneath it forms a part-section of the external surfaces of the housing in which the safety switch unit 1 is integrated. A housing of this type may be designed as a so-called handheld device or may be a stationary control desk for machines or robots. The safety switch unit 1 is particularly suitable for mounting in a casing or end region of a portable housing with integrated display and control elements. In particular, the safety switch unit 1 may be inserted in an opening or orifice of such a housing, in which case the elastic cover element 42 for the mechanical components of the safety switch unit 1 simultaneously serves as a seal for the housing in the region of the orifice, dividing it from the surrounding area. In particular, the rubber-like cover element 42 extends as far as the region of a mounting or retaining flange 44 (FIG. 1) used to secure the safety switch unit 1 in the interior of an appropriate housing. When the safety switch unit 1 is secured in a housing, the cover element 42 is therefore firmly clamped between the retaining flange 44 and the internal surfaces of the housing and therefore provides a dust-proof and liquid-tight screen for the orifice so that the safety switch unit 1 is sealed from the surrounding area of the housing once it is inserted. Consequently, no additional seals or adhesive are necessary because the opening from which the push button unit 2 is operated in the housing is already sealed by means of the soft-elastic rubber-like cover element 42. The important factor is that the rubber membrane 43 also forms a part-region of the external surfaces in the gripping or holding region of the corresponding housing accommodating the control electronics.

The control or evaluation device is designed in such a way that a control or switch signal indicating the same function must always be received from each switch circuit 4, 5. Should it suddenly happen that only one switch signal can be received, in particular only one confirmation signal or only one emergency stop signal, the control or evaluation device is able to conclude from this that the safety switch unit 1 is damaged or faulty, whereupon appropriate measures can be initiated, for example warning or error signals issued and/or a safety shut-down operated.

The two operating elements 6, 7 are mounted so as to pivot relative to a mounting frame 8 for at least one electric switch element 14, 15 of the two switch circuits 4, 5. In particular, each operating element 6, 7 has a respective pivot axis 11, 12, with two mutually independent pivot bearings 9, 10 for the two operating elements 6, 7. The two operating elements 6, 7 are displaceable in rotation to a limited degree via the two pivot bearings 9, 10 relative to the mounting frame 8 and the electric switch elements 14, 15. As illustrated most clearly in FIG. 3, the push button unit 2 is disposed in front of the two operating elements 6, 7, by reference to the operating direction—arrow 13—thereby enabling a substantially translating or linear operating motion of the safety switch unit 1 in the direction of arrow 13.

The push button unit 2 disposed in front of the operating elements 6, 7 is formed by a part-region of the elastically flexible cover element 42, indicated by broken lines in FIG. 3. In particular, the cover element 42 is of a plate-shaped or block-shaped design in the region overlapping the region where force is applied to the operating elements 6, 7 and the cover element 42 is of a higher stiffness or dimensional stability in the region where force is applied to the operating elements 6, 7 and optionally has a reduced coefficient of friction. The push button unit 2, which is preferably a rubber part integral with the cover element 42 in the form of a bellows with certain thicker regions, is preferably supported respectively on at least one projection of the operating elements 6, 7. These projections are shaped so that the operating elements 6, 7 have a lower friction than the underside of the push button unit 2 and can pivot relative to the cover element 42 accordingly. A linear displacement of the push button unit 2 as indicated by arrow 13 will therefore result in a rotating or pivoting motion of the operating elements 6, 7, thereby causing the electric switch elements 14, 15 to be switched or displaced by means of the pivoting motion.

The mounting frame 8 on which the operating elements 6, 7 are pivotably mounted by means of the pivot bearings 9, 10 is of a trough-type or box-type shape in this embodiment. This being the case, the two operating elements 6, 7 on either side of the mounting frame 8 constitute articulated flaps or cover elements which bound the mounting frame 8 at the top, as may best be seen from FIGS. 1 and 3. In addition, as may be seen from FIG. 4, the mounting frame 8 is substantially C-shaped in cross section and consists of a substantially flat base plate 49 from which legs 50, 51 at the oppositely lying side edges extend out substantially at a right angle to the base plate 49. The pivot bearings 9, 10 for the operating elements 6. 7 are disposed in the corner regions of the two legs 50, 51 remote from the base plate 49.

Disposed on the legs 50, 51 or alternatively on the base plate 49 is at least one retaining tab 52 for securing the safety switch unit 1 in the interior of a portable housing, for example for an electronic handheld device.

As best illustrated in FIG. 3, all electromechanical switch elements 14, 15 with the respective electrical switch contacts are disposed on a common printed circuit board 2. In particular. The first switch circuit 4 has a normally open contact 16 and a normally closed contact 18. The second switch circuit 5 likewise has a normally open contact 17 and a normally closed contact 19. The operating element 6 is provided as a means of displacing or switching the electric switch elements 14 of the first switch circuit 4 and the operating element 7 is provided as a means of switching or displacing the switch elements 15 of the second switch circuit 5.

The printed circuit board 22 with the electric switch elements 14, 15 is inserted and retained in position in the substantially C-shaped mounting frame 8 substantially without any clearance. In particular, a bottom face 53 of the printed circuit board 22 is supported as far as possible by its full surface on an opposing face 54 of the mounting frame 8 and on the base plate 49. The printed circuit board 22 together with the switch elements 14, 15 soldered thereto is therefore at least partially accommodated in the trough-shaped or housing-shaped mounting frame 8 and positioned in the mounting frame 8 by means of the legs 50, 51 and optionally additional webs. The printed circuit board 22 incorporating the switch elements 14, 15 can be easily inserted in the cage-type mounting frame 8 by moving the operating elements 6, 7 to the outwardly pivoted position or with the operating elements 6, 7 already accommodated in the mounting frame 8.

One advantage of this embodiment resides in the fact that the electromechanical switch elements 14, 15 can be accommodated and retained in the mounting frame 8 without any screw fittings. In practical terms, as soon as the printed circuit board 22 incorporating the switch elements 14, 15 is placed in the mounting frame 8, the operating elements 6, 7 can be pivoted into the initial or inactive position illustrated in FIG. 3, thereby preventing the switch elements 14, 15 or the entire printed circuit board 22 from falling out of the mounting frame 8.

To improve the way in which the switch elements 14, 15 are fixed and secured, flexible, resiliently elastic catch elements 55 are provided on the mounting frame 8, which secure the printed circuit board 22 relative to the mounting frame 8. These catch elements 55 thus form a sort of snap-fit connection between the printed circuit board 22 and the mounting frame 8, thereby enabling the safety switch unit 1 to be assembled without the need for tools. In particular, the printed circuit board 22 merely has to be slotted into the trough-shaped or housing-type mounting frame 8, without involving any screwing, and is secured ready for use.

As may be seen from FIG. 1, the mutually remote end regions 30, 31 of the two operating elements 6, 7 are respectively mounted so that they can be pivoted about the separate pivot axes 11, 12. The mutually facing ends 26, 27 of the operating elements 6, 7 merge with one another or engage with one another. In particular, the mutually facing ends 26, 27 of the two operating elements 6, 7 engage in a meshing arrangement with one another. This mutual meshing engagement is such that the two operating elements 6 and 7 are not joined to one another in displacement and can still be pivoted independently of one another. The requisite simultaneous displacement of the two operating elements 6, 7 is obtained due to the push button unit 2 as explained above, which is provided as a central portion of the cover element 42 disposed in front in the manner described above. The operating elements 6, 7 form operating surfaces 56, 57 in the transition region where they merge. These operating surfaces 56, 57 constitute a force-introducing zone 58 for the push button unit 2 disposed in front with respect to the operating direction—arrow 13. In order to improve rolling or sliding behaviour between the push button unit 2 and the operating elements 6, 7 to which force is applied, the operating elements 6, 7 have cambered, in particular convexly curved projections in the force-introduction zone 58. In particular, the operating elements 6, 7 have cam-type raised areas in the region of the force-introduction zone 58 to which the finger pressure of the user is transmitted via the interposed push button unit 2.

In this embodiment, therefore, the push button unit 2 is formed directly by the elastically resilient, deformable cover element 42, in particular in the form of a rubber membrane 43. This rubber membrane 43 preferably also fulfils the function of sealing off a housing orifice in which the safety switch unit 1 is inserted and operated with respect to the surrounding area of an appropriate housing.

Figure 2:
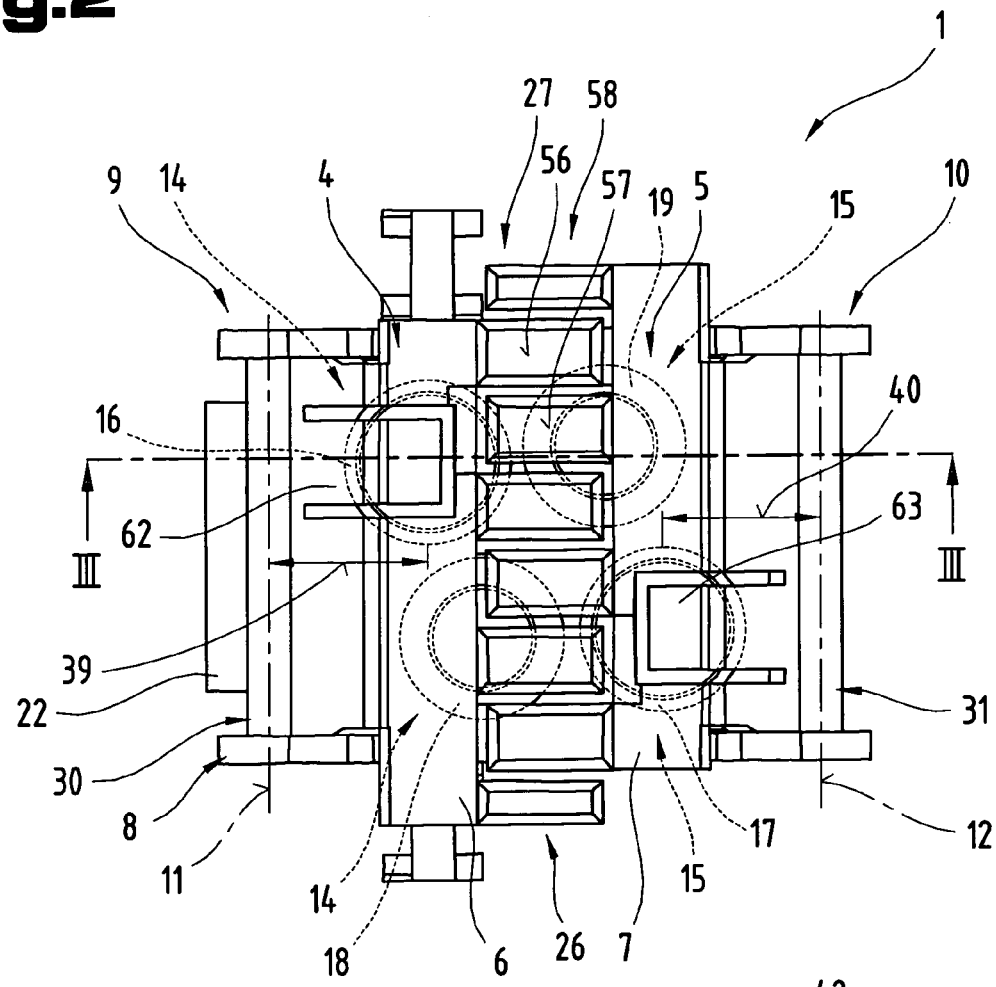
FIG. 2 is a plan view of the safety switch unit illustrated in FIG. 1 viewed in the direction of arrow II.

As illustrated most clearly in FIGS. 1 and 2, the two operating elements 6, 7 are exactly the same and are identical parts. The operating element 6 is therefore entirely of the same design as the operating element 7, so that only a few different parts are needed to build the safety switch unit 1. These features reduce manufacturing costs and make small and medium-sized batch production of the safety switch unit 1 relatively inexpensive.

The four switch elements 14, 15 of the safety switch unit 1 are respectively arranged offset from one another in two directions perpendicular with one another by reference to their seating or support plane 59, which as a rule is the component side of the printed circuit board 22. In other words, the switch elements 14, 15, in particular the two normally open contacts 16, 17 and the two normally closed contacts 18, 19 are disposed at the comers of an imaginary parallelogram. Looking down from above onto the seating or support plane 59, which is aligned substantially parallel with the base plate 49, the switch elements 14, 15 therefore constitute the comers or contour of a virtual parallelogram. This special layout of the switch elements 14, 15 enables identical parts to be used for the operating elements 6, 7, thereby reducing the manufacturing costs of the safety switch unit 1 without jeopardising quality or reliability.

Figure 6:
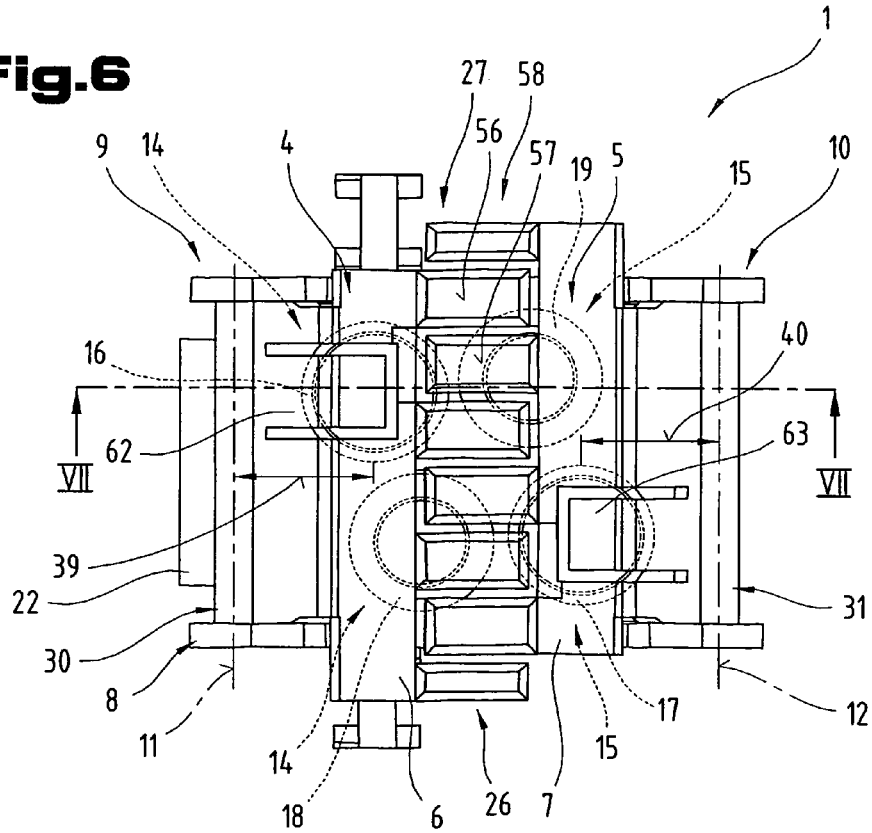
Figure 7:
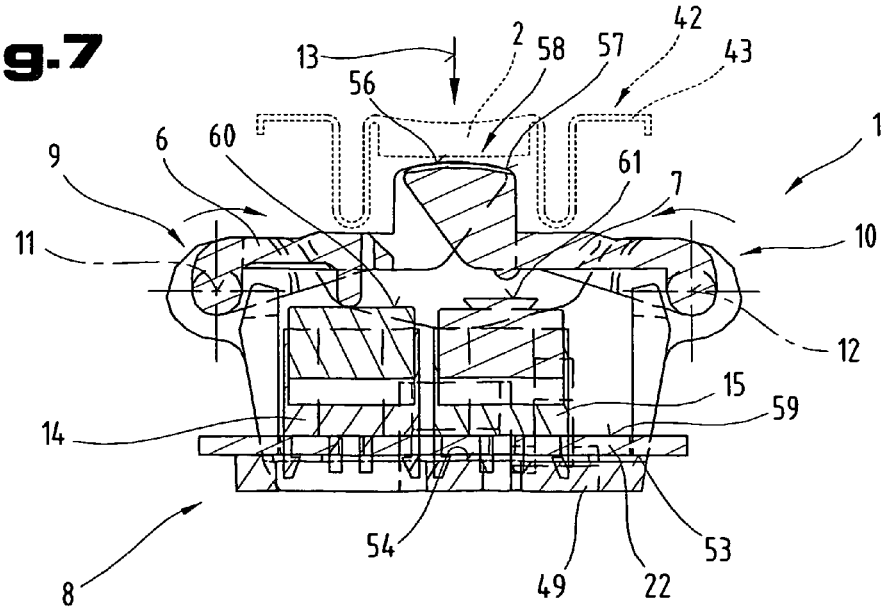
Figure 8:
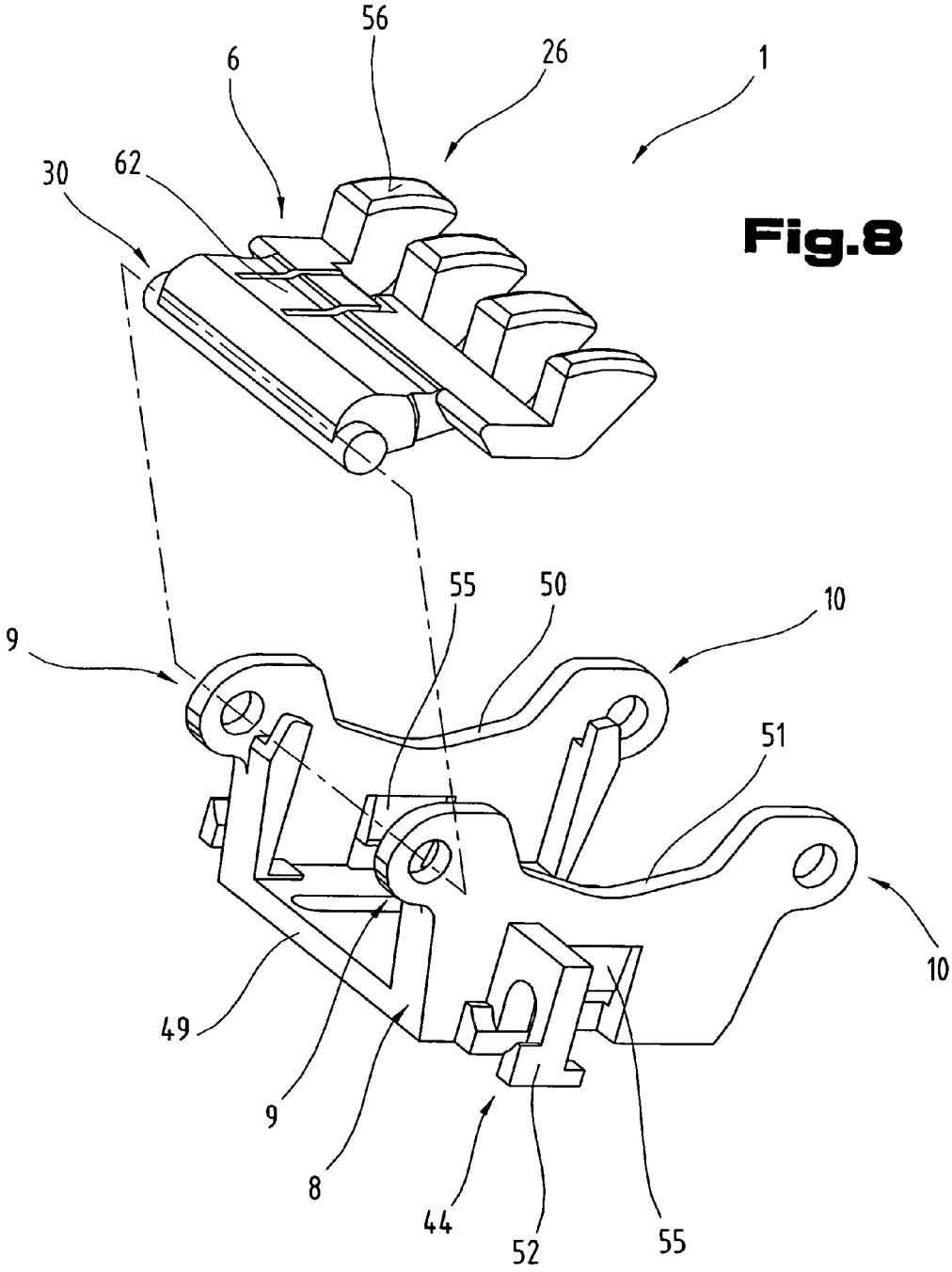

The switch elements 14, 15 incorporating the normally open contacts 16, 17 are also disposed at a shorter distance 39, 40 from the respective pivot axis 11, 12 of the co-operating operating element 6, 7 than the respective normally closed contact 18, 19 in the same respective switch circuit 4, 5. In particular, the normally closed contacts 18, 19 are closer to the middle region between the pivot axes 11, 12 than the two normally open contacts 16, 17, as illustrated most clearly in FIG. 6. As a result of the differing lever action of the operating elements 6, 7, starting from the respective pivot axis 11, 12, and the respective contact design of the switch elements 14, 15, there is a perceptible step in the amount of operating force which has to be applied in order for the confirmation position and the panic position to be assumed.

As illustrated most clearly in FIG. 3, operating surfaces 60, 61 of the switch elements 14, 15 lie substantially within a same plane. In other words, the structural height of the normally open contacts 16, 17 may be substantially the same as the structural height of the normally closed contacts 18, 19. In order to be able to provide different contact stages or switch positions with a displacement path disposed in between, the operating elements 6, 7 may each have a resiliently elastic, flexible compensating element 62, 63 co-operating with the switch elements 14, 15 incorporating the normally open contacts 16, 17. This compensating element 62, 63 is a sort of resiliently mounted tongue, the retaining force of which is enough to operate the adjusting element of the normally open contacts 16, 17. As the operating elements 6, 7 pivot farther from the second contact stage, the compensating elements 62, 63 are deflected out relative to the operating elements 6, 7 permitting a further pivoting motion of the operating elements 6, 7 into the third contact stage due to the increased force. In particular, the operating force acting on the normally open contacts 16, 17 can be limited, thereby preventing the normally open contacts 16, 17 from being subjected to excessive strain.

Another essential aspect is the fact that the switch elements 14, 15 are disposed with the normally closed contacts 18, 19 essentially directly underneath the force-introduction zone 58 where the operating elements 6, 7 merge with one another.

Another aspect of this embodiment of the safety switch unit 1 is that the operating elements 6, 7 can be pushed into the initial or inactive position by means of the intrinsic return force of the switch elements 14, 15, as illustrated in FIG. 3. Consequently, no additional spring means which would naturally increase the risk of breakage are necessary. The operating elements 6, 7 are returned to the initial or inactive position solely by means of the resilient or return means which exist in the switch elements 14, 15 in any event, provided no external force is being applied in the direction of arrow 13. The signals and switch states of the two switch circuits 4, 5 are processed and acted on accordingly by a control or evaluation device, not illustrated, which is directly integrated in the safety switch unit 1 or connected as a peripheral device.

For the sake of good order, it should be pointed out that in order to provide a clearer understanding of the structure of the safety switch unit 1, it and its constituent parts are illustrated to a certain extent out of scale and/or on an enlarged scale and/or on a reduced scale.

The invention claimed is:

1. Safety switch unit (1) for electrically controlled machines for use in combination with the actual control elements of the machine control system in a handheld application or manual operation, with at least one operating element (6, 7) which is displaced relative to a mounting frame (8) in accordance with the switching function desired by a user, which is designed to change the switch status of at least one electric switch element (14, 15), the safety switch unit (1) having at least one switch position which is maintained only as long as a sufficiently high operating force is applied to the displaceable operating elements (6, 7), wherein two operating elements (6, 7) for at least one respective electric switch element (14, 15) can be displaced in translation or rotation to a limited degree relative to the mounting frame (8) about a respective pivot axis (11, 12) of two pivot bearings (9, 10) and provide a substantially translating or straight operating movement of the safety switch unit (1) by means of a push button unit (2) which is disposed in front of the two operating elements (6, 7) by reference to the operating direction—arrow (13)—of the safety switch unit (1), each of the two operating elements being mounted to pivot on the respective pivot axis at their remote end regions (30, 31), and their facing ends engaging or overlapping.

2. Safety switch unit as claimed in claim 1, wherein the switch elements (14, 15) are conductively connected to an electronic control or evaluation device (3).

3. Safety switch unit as claimed in claim 1, wherein a bottom face (53) of a printed circuit board (22) for all switch elements (14, 15) or a bottom face of the switch elements (14, 15) is supported as far as possible by its full surface on an opposing face (54) of the mounting frame (8).

4. Safety switch unit as claimed in claim 3, wherein the printed circuit board (22) is inserted in the housing-type mounting frame (8) without screws.

5. Safety switch unit as claimed in claim 1, wherein the mutually facing ends (26, 27) of the two operating elements (6, 7) overlap with one another in a meshing arrangement but are not linked to one another in displacement and can still be pivoted independently of one another.

6. Safety switch unit as claimed in claim 1, wherein mutually merging operating surfaces (56, 57) of the two operating elements (6, 7) form a force-introduction zone (58) for the push button unit (2).

7. Safety switch unit as claimed in claim 6, wherein the operating elements (6, 7) are upwardly cambered or curved in a cam-type design in their common force introduction zone (58).

8. Safety switch unit as claimed in claim 1, wherein the elastically flexible cover element (42) is plate-shaped or block-shaped in the region congruent with the zone (58) via which force is transmitted to the operating elements (6, 7) and is stiffer than the peripheral zones lying around it.

9. Safety switch unit as claimed in claim 1, wherein operating surfaces (60, 61) of the switch elements (14, 15) lie in a substantially common plane and the two operating elements (60, 61) each have a resiliently elastic, flexible compensating element (62, 63) co-operating with the switch elements (14; 15) incorporating the normally open contact (16, 17).

* * * * *